US006711994B1

(12) United States Patent
Daniel et al.

(10) Patent No.: US 6,711,994 B1
(45) Date of Patent: Mar. 30, 2004

(54) WIRE-TIE PULL PINS

(75) Inventors: Barton Wade Daniel, Kennesaw, GA (US); Gerald Lee Johnson, Carthage, MO (US); Samuel E. Jones, Carthage, MO (US); Harold Campbell Lummus, Jr., Cataula, GA (US); Craig Van Millett, Granby, GA (US); Timothy Charles Stamps, Carl Junction, MO (US); Ray Whittinghill, Carthage, MO (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 09/540,156

(22) Filed: Mar. 31, 2000

(51) Int. Cl.[7] ..... B65B 13/20; B65B 13/06
(52) U.S. Cl. ..... 100/26; 100/3; 100/31
(58) Field of Search ..... 100/2, 3, 14, 26, 100/31; 53/528, 529, 589

(56) References Cited

U.S. PATENT DOCUMENTS

| | | | | |
|---|---|---|---|---|
| 2,632,381 A | | 3/1953 | Buckland | |
| 2,780,986 A | | 2/1957 | Ritenour | |
| 2,920,553 A | * | 1/1960 | Van Marle | 100/27 |
| 3,070,001 A | | 12/1962 | Feldkamp | |
| 3,470,813 A | | 10/1969 | Nomm et al. | |
| 3,568,591 A | | 3/1971 | Dunlap | |
| 3,621,888 A | | 11/1971 | Ericsson | |
| 3,665,845 A | * | 5/1972 | Lyon | 100/27 |
| 3,720,158 A | | 3/1973 | Sauer et al. | |
| 3,771,435 A | * | 11/1973 | Vascotto et al. | 100/27 |
| 3,834,297 A | | 9/1974 | Huson | |
| 3,863,558 A | | 2/1975 | Trumbo | |
| 3,910,089 A | | 10/1975 | Meier et al. | |
| 3,921,799 A | | 11/1975 | Meier | |
| 3,935,616 A | | 2/1976 | Simmons | |

(List continued on next page.)

FOREIGN PATENT DOCUMENTS

JP 06179418 A * 6/1994 ..... 53/528

OTHER PUBLICATIONS

Videotape; Cranston Wire Tying; approximate date 1985; approximate length 4 minutes.

Videotape; Samuels Strapping System, Mosely Gin, Abbeville AL; date as early as Mar. 31, 2000; approximate length 4 minutes.

*Primary Examiner*—Stephen F. Gerrity
(74) *Attorney, Agent, or Firm*—Husch & Eppenberger, LLC; Grant D. Kang; Robert C. Haldiman

(57) ABSTRACT

A bale binding machine utilizes controlled pins to guide the path of a wire (or strap) around a bale such that strength-reducing bending is not introduced to the wire. The bale binding machine binds bales of fibrous bulk materials such as cotton and nylon.

9 Claims, 7 Drawing Sheets

U.S. PATENT DOCUMENTS 3,999,476 A * 12/1976 Thompson ..... 100/26
4,024,805 A * 5/1977 Glasson ..... 100/26
4,031,594 A 6/1977 Cepuritis
4,048,697 A 9/1977 Duenser
4,062,086 A 12/1977 Wojcik
4,079,667 A 3/1978 Lems et al.
4,080,689 A 3/1978 Meier
4,090,440 A 5/1978 Jensen
4,156,385 A 5/1979 Lems et al.
4,158,994 A 6/1979 Jensen
4,226,007 A 10/1980 Duenser
4,228,565 A 10/1980 Lems et al.
4,378,262 A 3/1983 Annis, Jr.
4,391,186 A 7/1983 Davis
4,393,763 A * 7/1983 Sauer et al. ..... 100/28
4,403,542 A 9/1983 Lewis
4,409,061 A * 10/1983 Buttner ..... 100/27
4,423,673 A * 1/1984 Ball ..... 100/28
4,450,763 A 5/1984 Saylor
4,466,535 A 8/1984 Huson
4,484,518 A 11/1984 Jaenson
4,501,356 A 2/1985 Urban et al.
4,520,720 A 6/1985 Urban et al.
4,534,817 A 8/1985 L'Sullivan
4,584,935 A 4/1986 Luggen
4,611,534 A 9/1986 Kudlicka et al.
4,625,635 A 12/1986 Lewis
4,649,812 A 3/1987 Mouret
4,665,815 A 5/1987 Fleissner
4,787,425 A 11/1988 Saylor
4,951,562 A 8/1990 Ribaldo
5,039,250 A 8/1991 Janz
5,070,779 A 12/1991 Molitorisz
5,117,536 A 6/1992 Beach et al.
5,133,532 A 7/1992 Figiel et al.
5,379,687 A 1/1995 Moseley
5,417,320 A 5/1995 Velan et al.
5,477,724 A 12/1995 Velan et al.
5,483,837 A 1/1996 Velan et al.
5,546,855 A 8/1996 Van Doorn et al.
5,644,978 A 7/1997 Jaenson et al.
5,673,614 A 10/1997 Jaenson et al.
5,689,934 A 11/1997 Scherer et al.
5,746,120 A 5/1998 Jonsson
5,826,499 A 10/1998 Bullington
5,870,950 A 2/1999 Wiedel

* cited by examiner

WIRE-TIE PULL PINS

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

1. Field of the Invention

This invention relates generally to a bale binding machine utilizing controlled pins and, more particularly, a bale binding machine that utilizes controlled pins to guide the path of a wire (or strap) around a bale such that strength-reducing bending is not introduced to the wire. The bale binding machine binds bales of fibrous bulk materials such as cotton and nylon.

2. Related Art

Fibrous bulk materials include cotton and nylon. Fibrous bulk materials are commonly formed into bales by compression and binding. There is a continuing need in the art to improve this bale binding process by improving efficiency, reliability and accuracy. There are various constraints on improvements to the bale binding process including: (1) the nature of the fibrous material; (2) the compressive force or loading; and (3) the loading of the fibrous material into a bale compression box ; (3) wrapping baling wire around the bale.

These constraints interact to create control challenges. For example, the compressive force required to compress bulk fibrous material to a certain physical volume fluctuates. Specifically, variations in heat and humidity cause the fibrous material to expand or contract, with an expanded material volume requiring more compressive force to compress the material to a particular volume, and a contracted material volume requiring less force for compression. In addition, when a compressed, originally-contracted material is later exposed to heat and humidity, the material attempts to expand, imposing additional stresses on the baling wire.

Due to the very nature of any bulk material, when the material is loaded into the compression box prior to compression, the bulk material can become unevenly distributed within the compression box. When the compressing ram compresses the unevenly distributed bulk material, some portions of material experience greater compression than other portions. After the baling wires are applied and secured around the bale, the compression on the bale is released and the fibrous bulk material of the bale expands in volume. Because the distribution of material in the bale is uneven, a varying amount of tension is experience by the baling straps or baling wires. An excessive amount of tension in baling straps or baling wire applied through the expansion of bulk material can cause the baling strap or wire to fail. Alternatively, the baling wire has the potential to elongate have the length altered in some way.

Baling wire or baling strap performance requirements vary depending on the bulk material at issue. Such requirements range from general operational parameters to industry to standard specifications. The Cotton Council has a baling constraint wherein the length of the wire (or strap) around the bale must fall within a particular range and the tension that the wire (or strap) must withstand has a particular range.

U.S. Wire Tie, a company based in Carthage, Mo., has an existing system, the 340 Series, for baling bulk materials. This system uses a hydraulic twist knot wire tying system to bind bales. In such systems, 8 gauge wire is utilized as the baling wire. However, hydraulic systems are slowly becoming less desirable because any leak of hydraulic fluid onto the bulk material ruins the material and requires that the baling equipment be cleaned prior to restarting the baling operation. To avoid the ruination of bulk material and prevent the loss of operational time and avoid the accompanying cleaning costs, this, there is a need in the art to provide a power source for a baling machine that does not use hydraulic fluid.

As the inventors have explored the feasibility of electric systems, it has been discovered that such systems require electrically-powered, knot-tying heads that are substantially larger than hydraulic knot-tying heads. This larger dimension, however, results in an inability to feed the wire around the bale with enough clearance from the bale to permit tying and still fall within the required length and strength specifications of the Cotton Council. Alternatively, it has been discovered that the baling wire must be sharply bent to achieve the length specification of the Cotton Council. However, any sharp bend in the wire decreases the ability of the wire to withstand the expansion forces of a cotton bale that has been released from compressive force.

In addition, as bulk material such as cotton or nylon is a commodity item, production costs are always examined to determine where such costs may be lowered. One heretofore fixed cost is the baling wire or strap. Costs for baling wire or baling strap are generally based on volume. Accordingly there are no options for lowering such cost without increasing purchasing volume. However, if the gauge of the wire can be increased without sacrificing strength, the smaller diameter wire (or strap) will be cheaper, thus reducing overall production cost.

Accordingly, there is a need in the art to provide an electrically powered baling system that can meet the requirements of the Cotton Council.

There is also need in the art to provide a baling system that utilizes a smaller gauge of wire for baling bulk material.

SUMMARY OF THE INVENTION

It is in view of the above problems that the present invention was developed. The invention controls stresses applied to a baling wire by employing pull pins. The wire is directed around the pull pins to moderate bending in the baling wire. This is because the pull pins are disposed between a wire track and a wire tying head. Without the pull pins, the baling wire would circle around the wire track and bend sharply to (and travel linearly to) the tying head. With the pull pins, the wire assumes an arcuate shape between the wire track and the tying head. It is critical to the invention that the pull pins are longitudinally movable, with the use of a solenoid. The pull pins are extended to guide the baling wire, and are retracted to avoid interference when the bale is released from a compression box and meets the wire.

Because the pins reduce wire stress, while avoiding interference when the bale is released, the present invention permits a reduction in wire size to 10 gauge wire. While less expensive, 10 gauge wire was, until the present invention, considered incapable of reliably binding bales of cotton.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DESCRIPTION OF THE PREFERRED EMBODIMENTS

Figure 1:
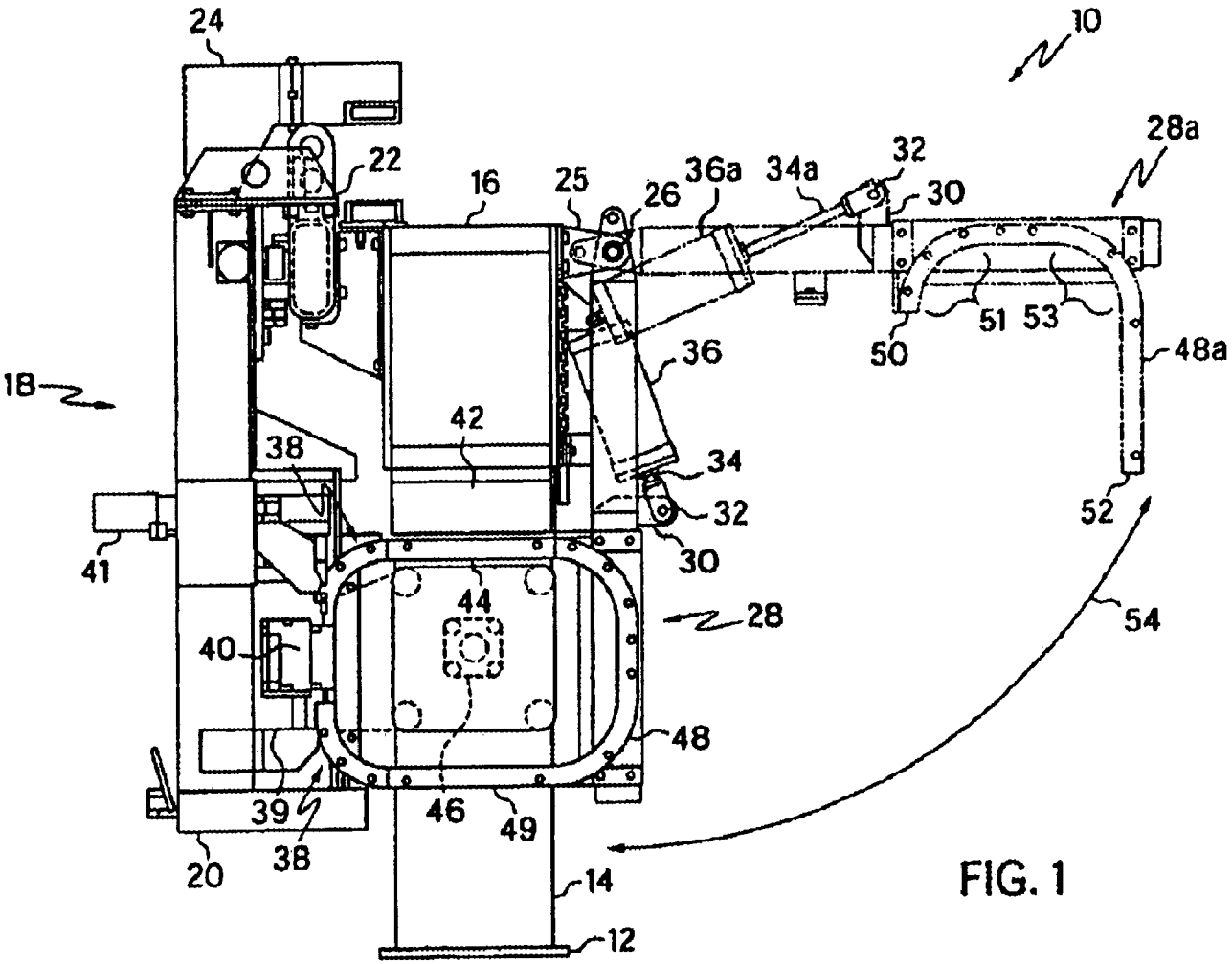
FIG. 1 is a plan side view of the preferred embodiment of the present invention.

Referring to the accompanying drawings in which like reference numbers indicate like elements, FIG. 1 illustrates a side view of the preferred embodiment of the present invention, a bale forming and binding apparatus 10, in two arrangements; the solid lines depicting the arrangement wherein the movable wire guide section 48 completes the wire guide track trajectory 45 as when the binding operation is occurring, and the broken lines depicting the arrangement wherein the movable wire guide section 48 is in a position 48*a* when a bale (not shown) is removed from the bale forming and binding station 16. A floor plate 12 supports vertical support stands 14 on either side of the bale forming and binding station 16. A binding assembly carriage 18 is borne by stands 14. The base extension 20 of the carriage 18 carries the fixed tying heads 40 and attached wire guide track sections 39. The carriage 18 translates in a direction perpendicular to the plane of the drawing along an overhead track 22 attached to the upper rear extent of the stands 14 and its motion is controlled by drive 24.

Extending from the upper forward extent of the stands 14 are a pair of pivot axis brackets 25 holding the pivot axis 26 which carries the movable guide track support strut assembly 28. Extending forward from the center of the strut assembly 28 is a member 30 pivotally connected at pin 32 to the piston arm 34 which is extended and withdrawn by action of the piston 36. The action of the piston 36 may be by any means but is preferably pneumatic.

Guide track section 44 lies in a channel within the bale forming compressor 42. Compressor 42 accommodates the wire trajectory above the bale forming station 46 containing the bulk material (not shown). The positions 28*a*, 34*a*, 36*a* and 48*a* show the parts 28, 34, 36 and 48 in their respective positions when the apparatus is in a second position whereby the movable guide track section 48 is pivoted away from the bale forming station 46. The upper movable guide track section terminus 50 and the lower movable guide track section terminus 52 meet the guide track sections 46 and 38 respectively to complete the wire guide track. The dashed line 54 illustrates the path of motion of the lower terminus 52 as it transits between arrangements.

Figure 2:
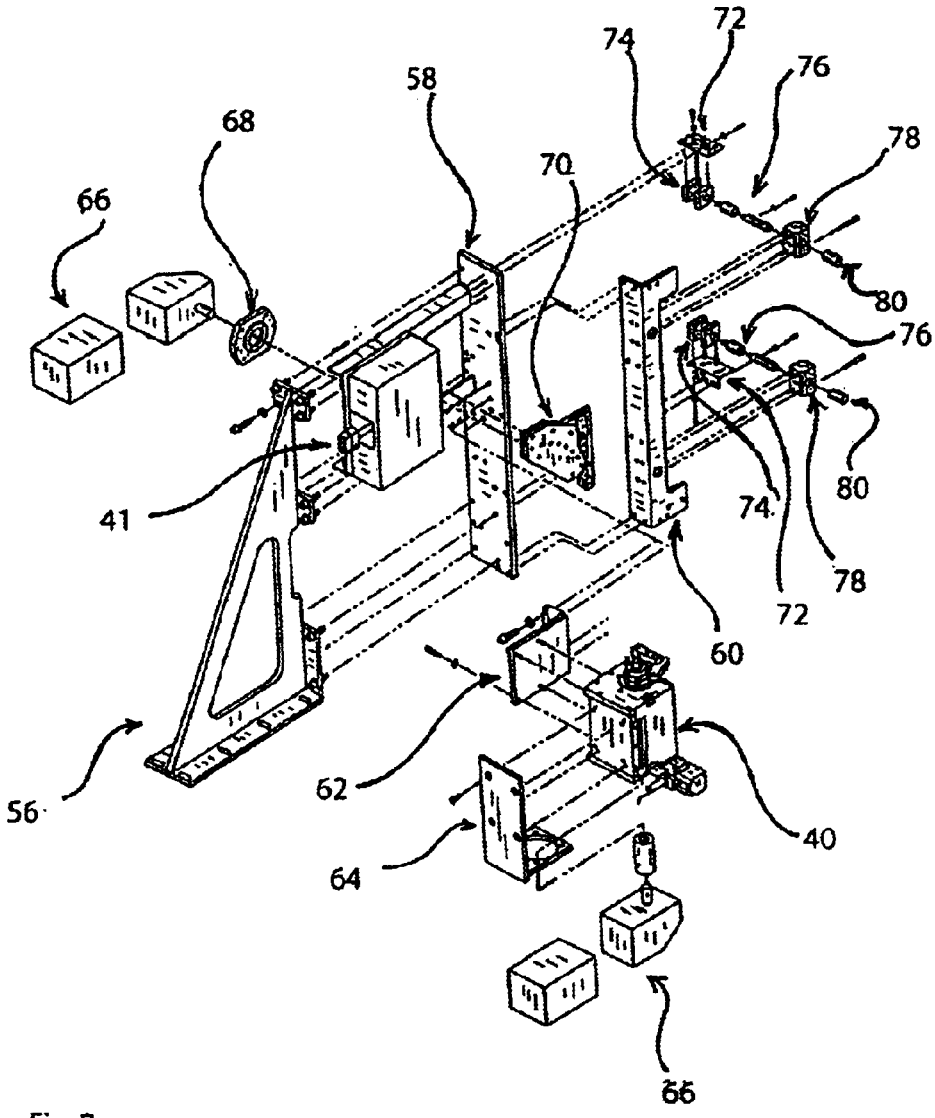
FIG. 2 is an exploded perspective view of a wire feeding and tying assemblies in combination with a tie pull pin device of the preferred embodiment of the present invention.

Referring to FIG. 2, a head frame gusset 56 attached below to the base extension 20 (not shown) anchors head mounting plate 58 which in turn anchors track mount 60. Head mounting bracket 62 is affixed at its front to head mounting plate 58 and along its side to wire tie head 40 which in turn is attached at the rear and below to tie head motor mount 64 through which a servo motor and gear reducer 66 connect to tie head 40. Head mounting plate 58 bears along its upper extent electric wire feed and tensioner 41 which is driven by a servo motor and gear reducer 66 through feed and tension servo adapter plate 68. 90° wire track entry guide 70 connects at its upper rear to tensioner 41 and at its lower front to an entry section of the wire track guide (not shown). Upper and lower tie pull pin assemblies 80 are supported by pin brackets 72 which in turn are affixed to head mounting plate 58 for the upper pin assembly and to track mount 60 for the lower assembly. The brackets 72 bear tie pin cylinders 74 which maintain and control tie pull pins 76 which in turn translate on their longitudinal axis through pin alignment couplers 78.

Figure 3:
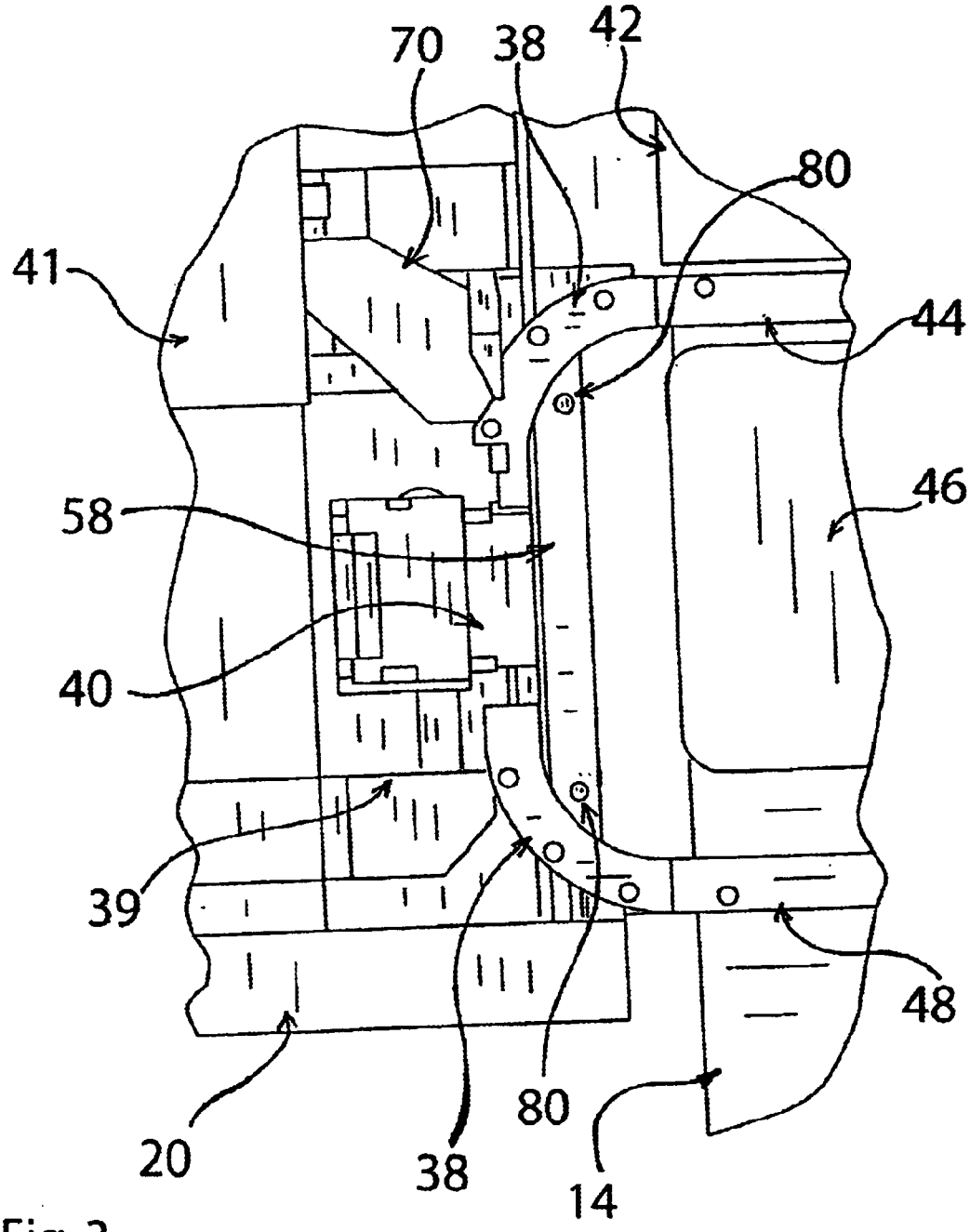
FIG. 3 is a side view of a portion of the preferred embodiment of the present invention depicted in FIG. 1 showing the general area of the assembly depicted in FIG. 2.

Referring to FIG. 3, the assembled configuration of the parts shown in FIGS. 1 and 2 is shown in a side view of the apparatus, centered in the area of the tie heads 40. The tie pins 80 are seen in their spatial relation to the wire guide tack sections 38, 44 and 48; and in relation to the tie head 40. The motion of the tie pins 80 is preferably in a linear direction perpendicular to the plane of the Figure in the preferred embodiment. However, this motion is not limited to a linear direction, as any movement which accomplishes the object of selectively modifying the wire path and accomplishes the object of selectively moving out of the wire path is also within the scope of the invention.

Figure 4:
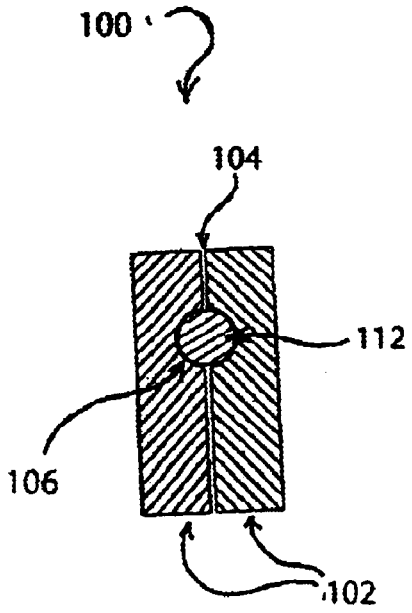
FIG. 4 is a cross-sectional view taken along line 4—4 in FIG. 1 of a wire guide track in a closed configuration for controlling the path of the binding wire.
Figure 5:
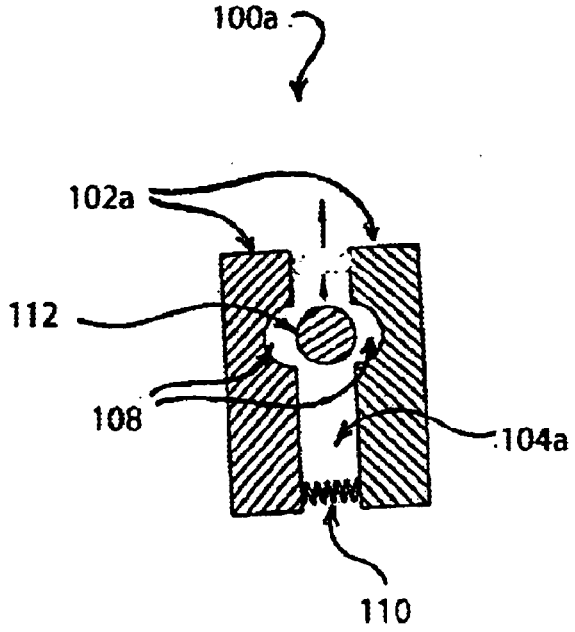
FIG. 5 is a cross-sectional view taken along line 5—5 in FIG. 1 of the wire guide track in an open configuration for releasing the binding wire following its fastening into a closed loop.

Referring to FIGS. 4 and 5, cross-sectional schematic views of a wire guide track section 38, 44 or 48 in a closed configuration 100 and an open configuration 100*a* are illustrated. FIG. 4 shows the wire 112 in the channel 106 formed between the two sides 102 of the track configuration 100. A space 104 between the sides 102 is closed to passage of the wire in the configuration 100. In FIG. 5 an open configuration 100*a* of a wire guide track section 38, 44 or 48 is shown wherein the sides 102 are in the arrangement 102*a* spaced sufficiently apart as mediated by the spring means 110 so that channel 106 is decomposed into the opposing hollows 108 and the space 104*a* is able to admit passage of the wire 112 in the direction of the arrow towards the bale (not shown).

Figure 6:
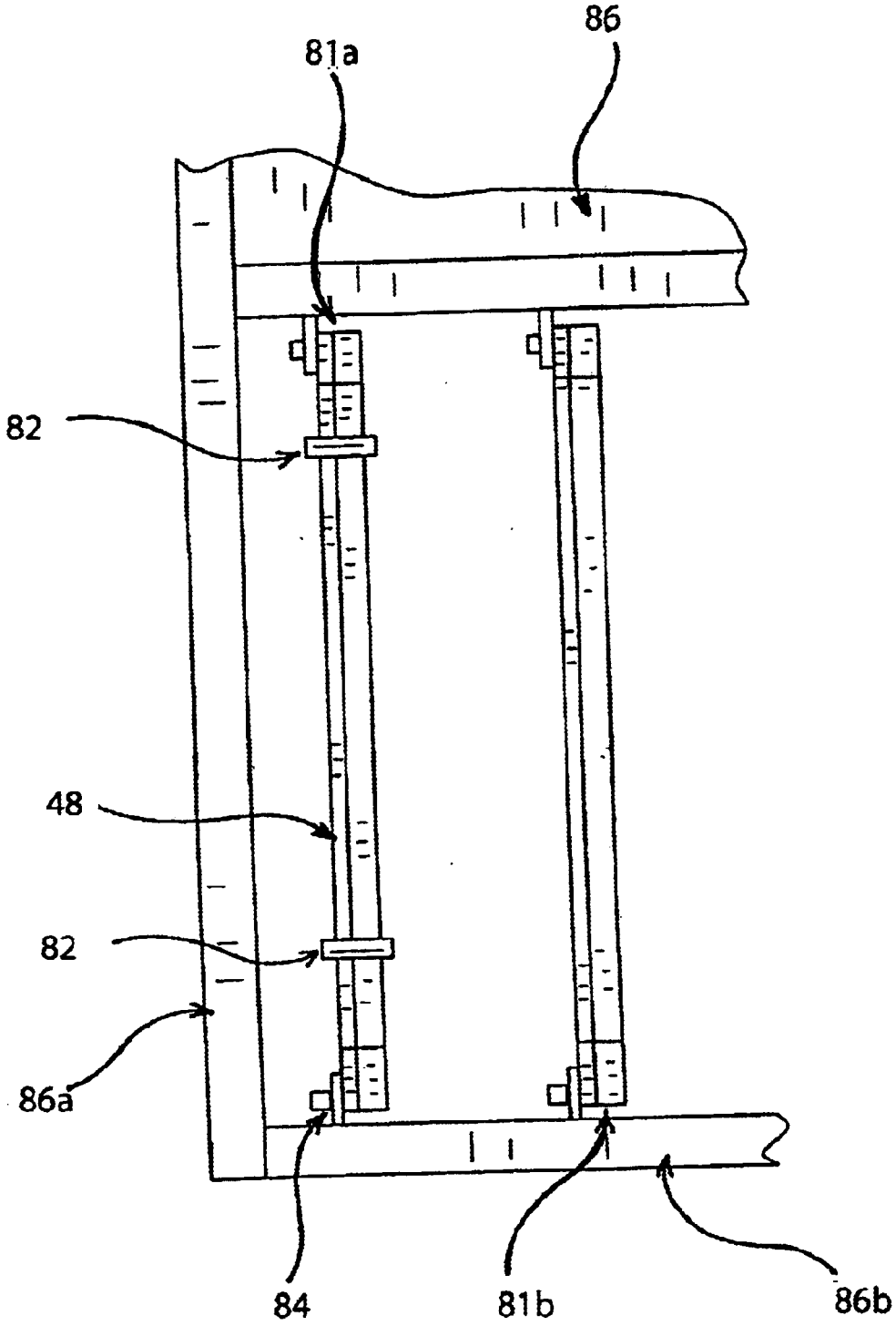
FIG. 6 is a front plan isolated view of the wire guide tracks and tie pull pins of the preferred embodiment of the present invention depicting the tie pull pins in a first position for fastening the wire into a closed loop, wherein portions of the baling machine have been removed to enhance clarity.
Figure 7:
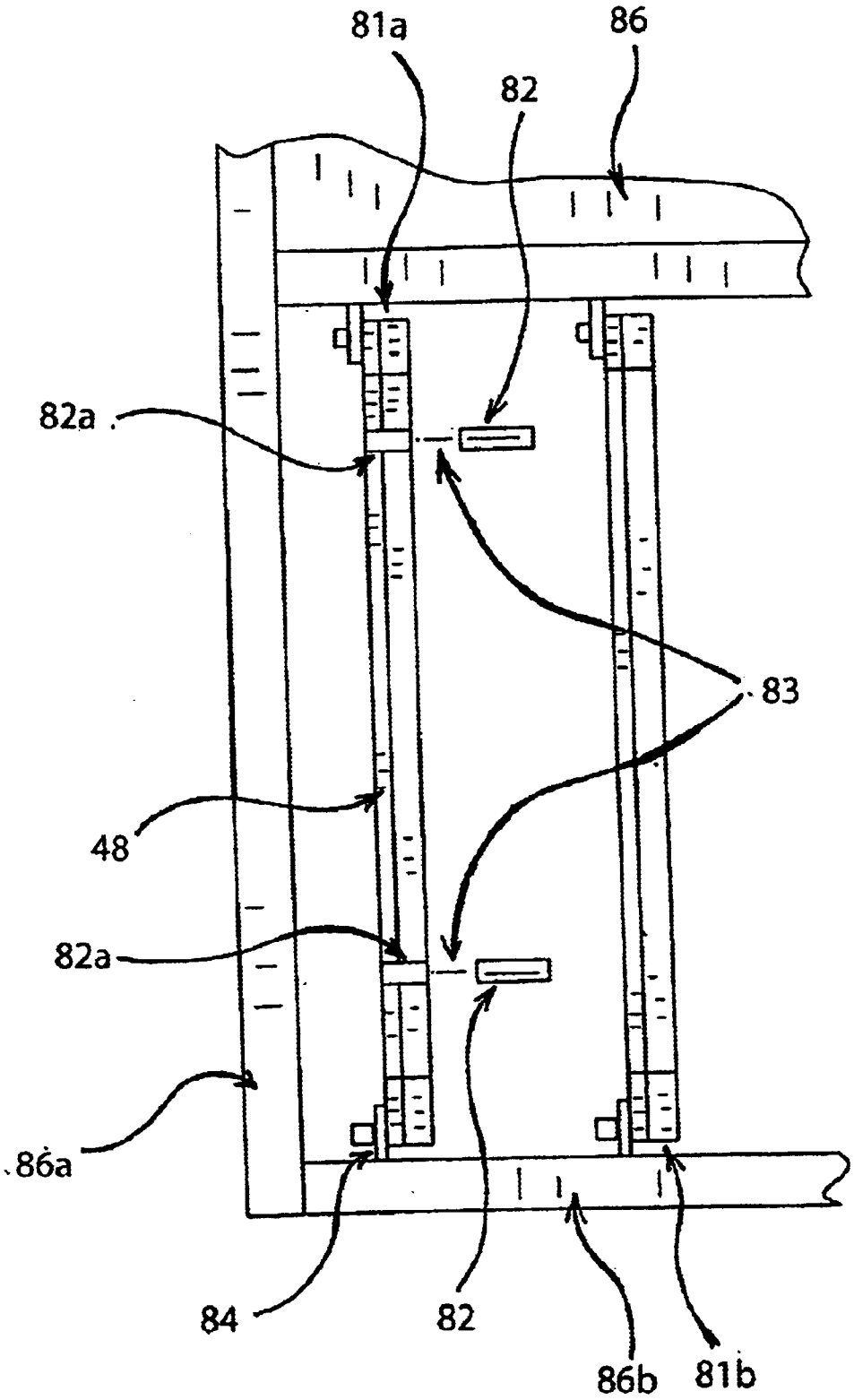
FIG. 7 is a front plan isolated view of the wire guide tracks and tie pull pins of the preferred embodiment of the present invention depicting the tie pull pins in a second position for releasing the wire during its fastening into a closed loop, wherein portion of the baling machine have been removed to enhance clarity.

Referring to FIGS. 6 and 7 the upper cross member 86, lower cross member 86*b* and a side member 86*a* of the strut assembly 28 are partially illustrated. Two (of six in total, four not shown) wire guide tracks 48 in the positions 81*a* and 81*b* are attached to the strut assembly 28 by stays 84. In FIG. 6 the tie pull pins 82 are shown in a first position for wire path modification as when the twist knot is being tied. In FIG. 7 the pins 82 are shown in a second position (separated by a remove 83 from the pin position 82*a* of FIG. 6). The pins 82 move in the direction of remove 83 when the wire twisting is not occurring. The pins 82 may be moved from their first position to their second position by any means but are preferably controlled pneumatically.

Figure 8:
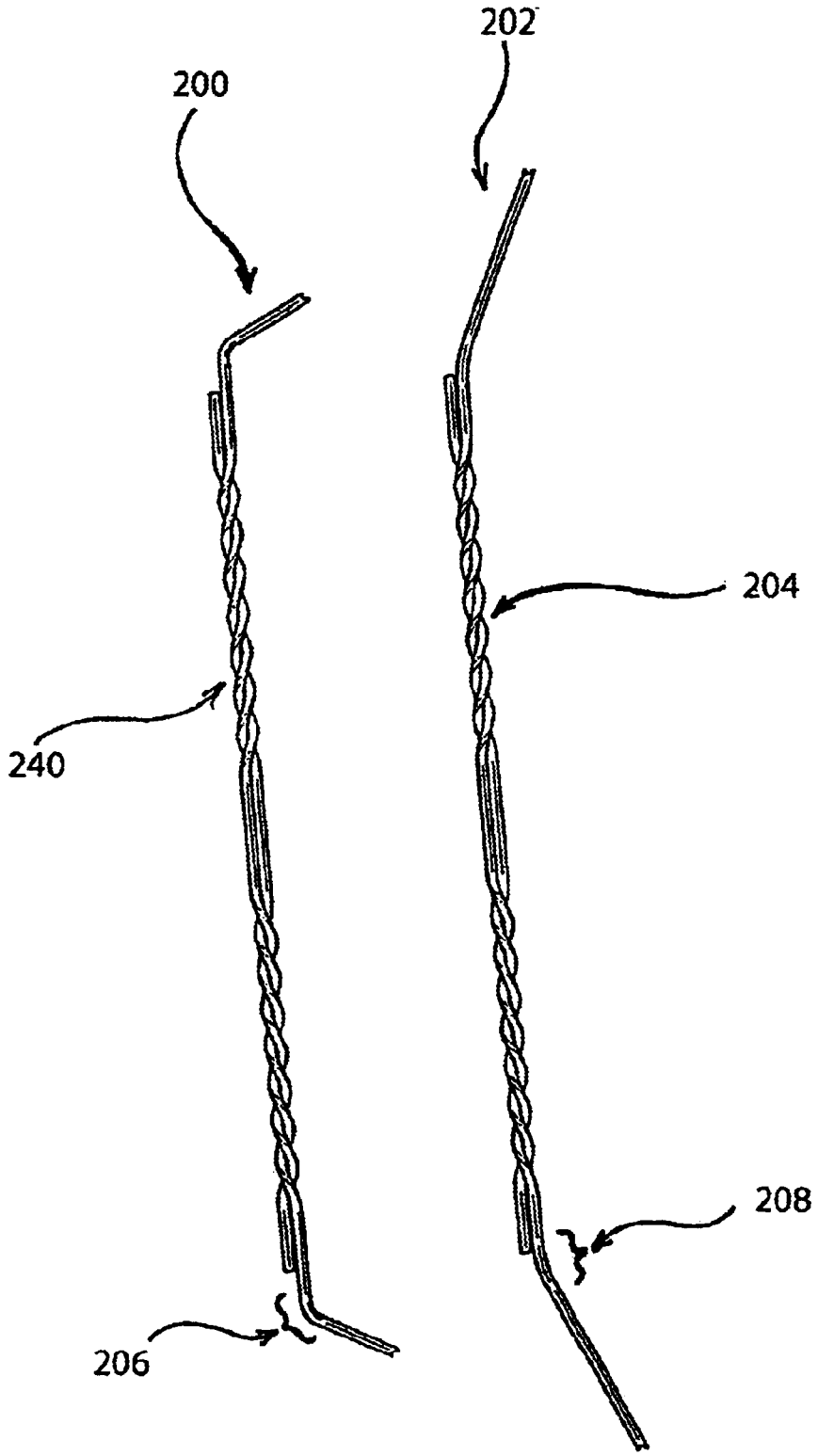
FIG. 8 is a view of a wire twist knot (right side) with a gentle bend angle resulting from the preferred embodiment of the present invention and a wire twist knot (left side) with a sharp bend angle which results without the benefit of the present invention.

Referring to FIG. 8, two wire twist knots are shown. On the left side, a first knot 200 would result without the improvement to the tying action provided by the presence of the tie pull pins. On the right side, a second knot 202 results from the improvement to the tying action caused by the presence of the tie pull pins. In the knot 200 a first bend angle or transition zone 206 to the twisted section 204 is shown to be of substantially greater curvature than the second bend angle or transition zone 208 of the knot 202.

In operation, when the movable guide track support strut assembly 28 is down, the binding wire entering the apparatus 10 from the wire supply (not shown) at the wire control head 41 and enters the tying head 40. Within tying head 40, the wire is gripped by a gripper (not shown). The gripper (not shown) rotates to push wire frictionally through the tying head 40 downward to the lower most guide track sections 38 and across, up, back, and then down the other guide track sections 38, and then back into tying head 40 until the end of the wire actuates a limit switch (not shown). The wire thus forms a loop section with an overlapping wire portion located within tying head 40. It is preferred to use ten (#10) gauge wire that is sold by U.S. Wire under the trade name ULTRA STRAP GALVANIZED.

At this point, tie pins 80 are extended. The tying head 40 twists the wire into a knot, resulting in the knotted portion shown on the right side of FIG. 8. In order to effect tying, tension is placed on the wire. This tension pulls the wire out of the two sides 102 as shown by the releasing action in FIGS. 4 and 5. As the wire is tensioned and breaks out of channel 106, the wire is pulled around pins 80. This assists the wire in assuming a less sharp bend as illustrated in FIG. 8.

Once the tying head 40 has completed the twist knot, tie pins 80 are retracted by solenoid (not shown) which retraction pulls tie pins 80 out of contact with the wire.

Then, carriage 18 can translate to a second indexed position along overhead track 22. Wire is again drawn by gripper (not shown) within tying head 40 to push the wire in a loop through guide track sections 38 and back into tying head 40. Then, the twist knot process repeats.

For cotton bales, six baling wires are used to bind a five hundred pound bale of cotton. Thus, if three indexing heads are mounted to carriage 18, carriage 18 must index between a first position and a second position to provide six straps.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-referenced exemplary embodiments, but should be defined only in accordance with the following claims appended hereto and their equivalents.

What is claimed is:

1. An improved binding strapping control and fastening device adapted to cooperate with a bale press comprising:

a guide for controlling a path of strapping utilized for binding a compressed bale of a bulk material wherein said strapping travels along said guide in the path around a perimeter of said compressed bale until an initial portion of the strapping completes a circuit of the guide and returns to proximity with a following portion of the strapping entering said guide, said guide having an end and said compressed bale having a top at a preconfigured first level and a bottom at a preconfigured second level;

a fastening mechanism for attaching said initial and following portions of the strapping to thereby form a closed loop retaining the bale in a compressed size upon cessation of compression, said fastening mechanism being located to effect said attaching when the initial and following portions of the strapping are in proximity, said fastening mechanism having an exit and an entry;

one of said exit or said entry of said fastening mechanism forming a first angle in said path relative to said preconfigured first level of said top of said compressed bale, and the other of said entry or said exit of said fastening mechanism forming a second angle in said path relative to said preconfigured second level of said bottom of said compressed bale;

at least one pin having a first position in said path and a second position remote from said path; and said at least one pin being located relative to said fastening mechanism and at least one of said preconfigured top level or said preconfigured bottom level of the compressed bale such that when said pin is in said path, said path is at a third angle relative to said fastening mechanism;

wherein said third angle is more oblique than said first angle or said second angle.

2. The strapping control and fastening device of claim 1, wherein said third angle relative to said fastening mechanism maintains a breaking resistance strength of the strapping.

3. The strapping control and fastening device of claim 1, wherein the strapping is metal wire.

4. The strapping control and fastening device of claim 1 wherein said at least one pin is selectively moveable such that during a fastening action said at least one pin is deployed in said first position which intersects the plane of the strapping loop to thereby modify said path of the released strapping and following the strapping action is removed to said second position outside of the plane of the strapping loop to thereby enable a complete release of the strapping loop to bind the bale.

5. The strapping control and fastening device of claim 1, further including at least a second pin disposed such that said path includes a fourth angle, said fourth angle being more oblique than said first angle or said second angle, and wherein said third angle supercedes said first angle and said fourth angle supercedes said second angle when said pins are in said first position in said path.

6. The strapping control and fastening device of claim 5, wherein said first pin is located adjacent to said entry and said second pin is located adjacent to said exit.

7. The strapping control and fastening device of claim 1, wherein said at least one pin enables the utilization of #10 gauge wire for a bale binding application determined to require a thicker gauge wire without said pin.

8. The strapping control and fastening device of claim 1 wherein movement of said at least one pin is automatic and controlled to synchronize with the bale forming and binding operations.

9. The strapping control and fastening device of claim 1, wherein said third angle is greater than 90 degrees.

* * * * *